United States Patent [19]

Grandin de L'Eprevier et al.

[11] Patent Number: 4,769,194

[45] Date of Patent: Sep. 6, 1988

[54] PROCESS FOR MANUFACTURING AN INSULATING FIBROUS PIECE AND PIECE THUS OBTAINED

[75] Inventors: Alain Grandin de L'Eprevier, Le Brethon; Albert Garnier, Heyrieux, both of France

[73] Assignee: Produits Cellulosiques Isolants - Procelis, Bourgoin Jallieu, France

[21] Appl. No.: 675,655

[22] Filed: Nov. 28, 1984

[30] Foreign Application Priority Data

Dec. 13, 1983 [FR] France ..... 83 20158

[51] Int. Cl.[4] ..... C04B 35/76

[52] U.S. Cl. ..... 264/60; 264/62; 264/86; 501/95

[58] Field of Search ..... 264/60, 86, 62; 501/95

[56] References Cited

FOREIGN PATENT DOCUMENTS 1292895 5/1962 France .

1602362 12/1970 France .

*Primary Examiner*—James Derrington

*Attorney, Agent, or Firm*—Parkhurst & Oliff

[57] ABSTRACT

The invention relates to a process for manufacturing an insulating fibrous piece based on fibers resisting high temperature, which consists in: preparing a first suspension containing a first type of fibers resisting high temperature; preparing at least one second suspension containing a second type of fibers resisting high temperature; then pouring each suspension into a distinct compartment of a vat of which the bottom comprises a momentarily obstructed filtering sieve and of which the elementary compartments are separated from one another by a removable plate, said process being characterized in that: each suspension also comprises a minority proportion of ceramizable particles; whilst withdrawing the removable separating plate, the medium is stirred locally at least in the vicinity of this separation plate, on the one hand, and, simultaneously, the water is drained through the filtering sieve, on the other hand, in known manner; and, after having dried the piece obtained, it is heated to a temperature capable of provoking in this piece the ceramization of said ceramizable particles.

9 Claims, 2 Drawing Sheets

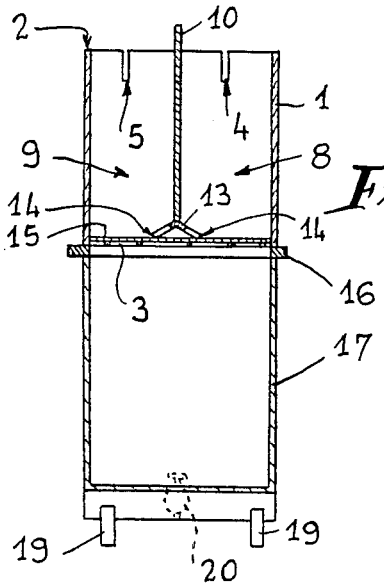
Fig. 2
Fig. 4
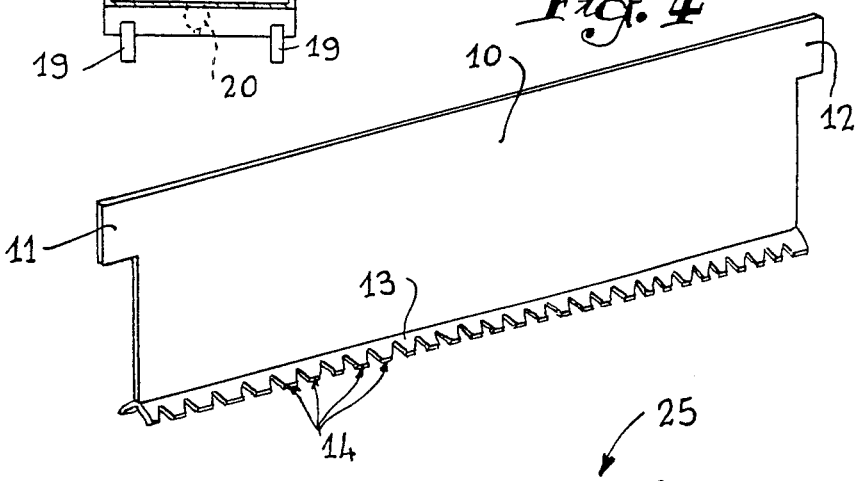
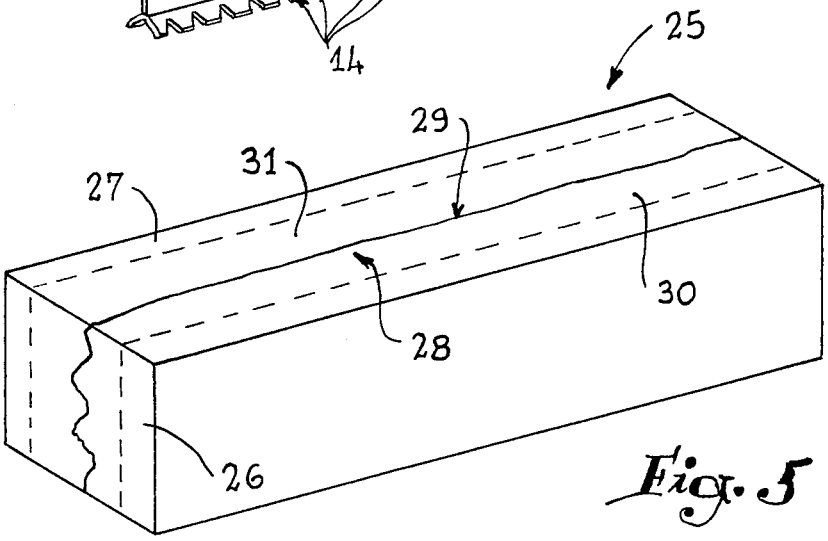
Fig. 5

PROCESS FOR MANUFACTURING AN INSULATING FIBROUS PIECE AND PIECE THUS OBTAINED

BACKGROUND OF THE INVENTION

The present invention relates to a process for manufacturing an insulating fibrous piece and also to the insulating fibrous pieces obtained according to this process.

It is well known to line enclosures intended to be taken to high temperature with a layer of an insulating material. To this end, refractory bricks were originally used. This technique, although wide-spread, presents the drawback of being expensive, of leading to heavy linings, sensitive to thermal shocks and which, for certain applications, have a high calorific capacity and a high thermal inertia.

For some years, it has been proposed to replace the bricks by fibrous sheets. In a first embodiment, it has been suggested to unwind on the wall to be lined sheets based on fibers resisting high temperature, such as ceramic fibers. These sheets are fixed parallel to the walls of the furnace by means of metal rods. These rods provoke thermal bridges, are corroded and precipitate corrosion of the walls of the furnace itself, and the fall of the sheets.

To avoid these drawbacks, in a second embodiment, it has been suggested to employ a stack of elementary sheets of fibers resisting high temperature, superposed edgewise or folded, fixed on the walls at the rear, which avoids the thermal bridges. This latter technique makes it possible only to effect a homogeneous insulation from the hot face to the cold face, which unnecessarily increases the cost thereof.

British Pat. No. 1 296 681 has suggested stacking successive layers of ceramic fibers on a form by means of vacuum. In this way, a progressive stack is obtained in which the elementary layers do not interpenetrate and of which the practical thickness is limited further to the technique of laying by suction.

SUMMARY OF THE INVENTION

The invention relates to a process for manufacturing an insulating fibrous piece, particularly for internally lining enclosures intended to be taken to high temperature, which is easy to carry out, economical, particularly for small-scale manufacture, and which enables pieces of appropriate dimensions and shapes with determined specifications to be conveniently produced.

This process for manufacturing an insulating fibrous piece based on fibers resisting high temperature, particularly for internally lining heated enclosures, which comprises in:

preparing a first suspension containing a first type of fibers resisting high temperature, preparing at least one second suspension containing a second type of fibers resisting high temperature, then pouring each suspension into a distinct compartment of a vat of which the bottom comprises a momentarily obstructed filtering sieve and of which the elementary compartments are separated from one another by a removable plate, said process being characterized in that:

each suspension also comprises a minority proportion of ceramizable particles;

whilst withdrawing the removable separating plate, the medium is stirred locally at least in the vicinity of this separation plate and, simultaneously, the water is drained through the filtering sieve;

finally, after having dried the piece obtained, it is heated to a temperature capable of provoking in this piece the ceramization of the ceramizable particles.

In other words, the invention resides:

in incorporating ceramizable particles in each suspension;

in withdrawing the removable plate separating each suspension by stirring it so as to provoke an interpenetration of the fibers of each suspension in the vicinity of the zone of separation, and this simultaneously to the elimination of the water;

finally, in heating the piece obtained under conditions sufficient to ceramize said ceramizable particles.

Advantageously, in practice:

the majority temperature-resistant fibers are ceramic fibers;

in a first embodiment, the minority ceramizable particles are inorganic particles such as for example particles of kaolin, which presents the advantage of not increasing the electrical conductivity of the finished product, or particles of clay, particularly particles of expanding clay such as bentonites, which present the advantage of being water-logged;

in a second preferred embodiment, the minority ceramizable particles are mechanical paper-making fibers, particularly salvaged fibers, this facilitating handling of the piece before baking, giving it a better resistance;

the proportion by weight of minority paper-making fibers is between 1 to 5% by weight of the dry weight of the majority ceramic fibers resisting temperature; if this proportion is less than 1%, insufficient ash, therefore binding matter, would be obtained after heating and, if this proportion is greater than 5%, the material would already tend to behave like cardboard, which, during drying, would involve shrinkage;

the concentration of fibers varies from one suspension to the other, but the quantity of suspension poured into each elementary compartment is identical from one suspension to the other to avoid overflow from one compartment into the other;

bulk fibers are preferably employed, which are dispersed in known manner in water;

to prepare each elementary suspension, a suspension is firstly made, containing fibers resisting high temperature, particularly in bulk, possibly with wetting agents added thereto, then another suspension prepared separately containing ceramizable particles is added to this suspension;

the concentration of each suspension is between 50 and 80 grams/liter as, below that, the quantity of water eliminated is too great, whilst, on the other hand, above that, the dispersion of the elementary fibers is poor;

the medium is stirred in known manner, for example either by a vibratory agitator or simply by arranging, either on the wall of the removable plate or at its lower end, a transverse comb element adapted to form a stirring member during withdrawal of this removable plate;

during filling of the elementary compartments of the vat, the sieve at the bottom of the vat is obstructed by a sheet of water which will be eliminated during the draining phase;

the ashes resulting from combustion of the paper-making fibers are ceramized at a temperature of at least 1000° C.;

after heating, the cooled piece may be coated with a new inorganic binding composition such as for example an aqueous solution of alumina phosphate which is then stove-dried.

BRIEF DESCRIPTION OF THE DRAWINGS

The invention will be more readily understood on reading the following description with reference to the accompanying drawings, in which:

FIGS. 2 and 3 respectively show this device in section along axes I-I' (FIG. 2) and II-II' (FIG. 3) in FIG. 1.

FIG. 4 is a summary perspective view of the removable plate of the device of FIG. 1.

FIG. 5 is a summary schematic view in perspective of an insulating piece according to the invention.

DESCRIPTION OF THE PREFERRED EMBODIMENTS

Figure 1:
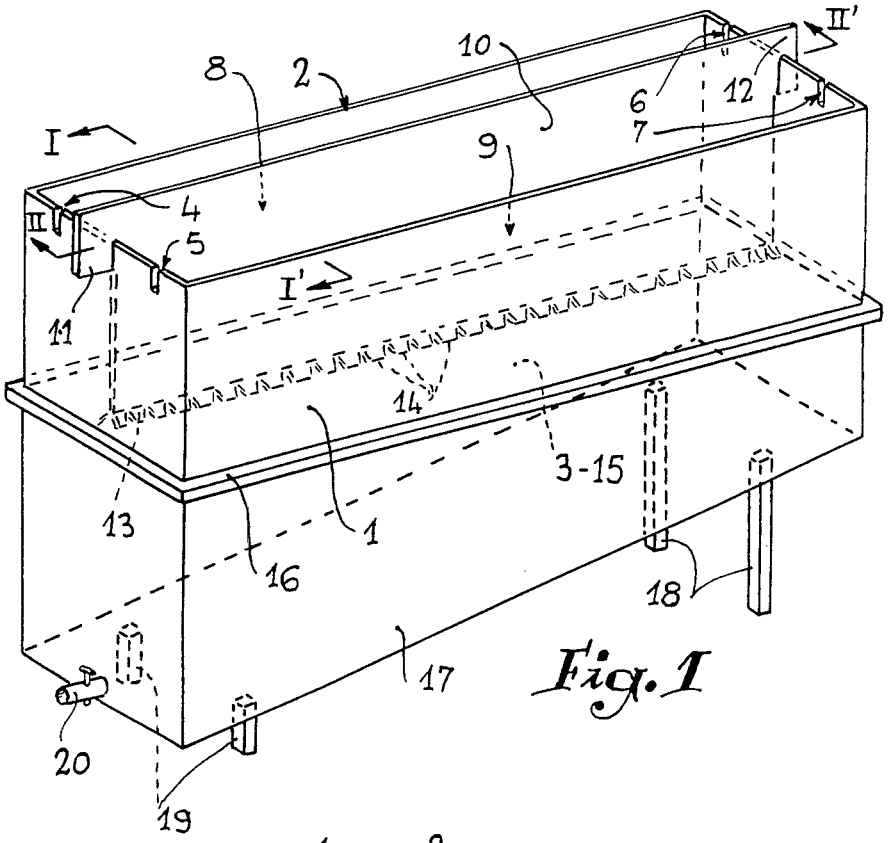
FIG. 1 is a summary schematic representation of a device for carrying out the process according to the invention.
Figure 3:
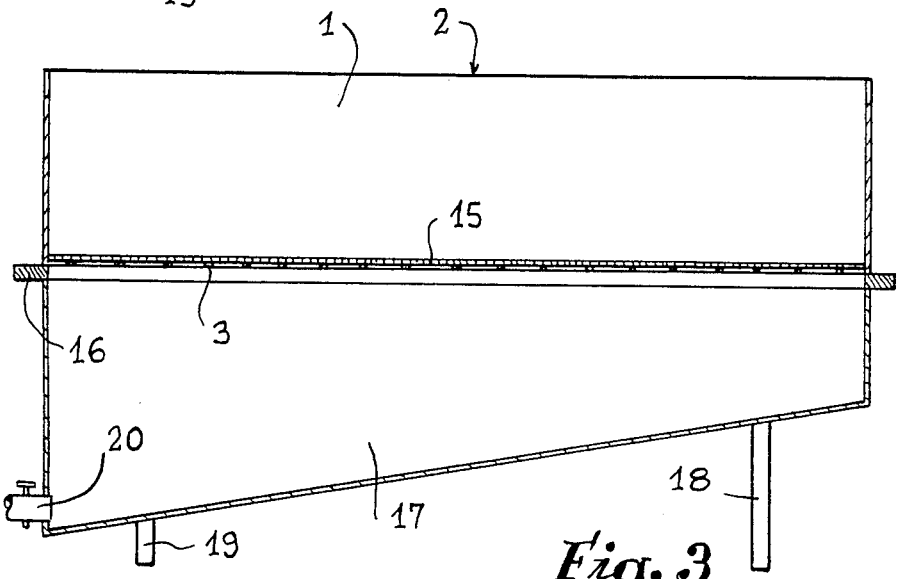

Referring now to the drawings, the device shown in FIGS. 1 to 4 for carrying out the process according to the invention is essentially composed of a vat 1, open at its upper end 2 and of which the bottom 3 is constituted by a considerably perforated, but resistant grid. This vat 1, for example made of sheet steel, comprises on two opposite edges an appropriate number of elementary slots 4, 5, 6, 7 adapted to define elementary compartments 8, 9, by the positioning of a rigid separating plate 10, likewise made of sheet steel for example, inserted in each of these slots 4,6-5,7. The surface of this removable separating plate 10 corresponds to the inner section of the vat 1. This plate 10 presents end tabs 11, 12 adapted to be inserted in the slots 4-7, and which project beyond the vat to allow positioning and withdrawal of the plate. The bottom of the separating plate 10 comprises a second, slightly concave transverse plate 13, adapted to come into contact with the sieve 15 placed on the perforated bottom 3. This piece 13, welded for example, presents a plurality of elementary edges 14 like a comb. As has already been stated, the bottom 3 composed of a considerably perforated grating, is covered with a metal filtering sieve 15 with a mesh size of 0.5 mm. The bottom of the vat 1 comprises a flange 16 for connection to the body 17 and for maintaining the sieve 15. The body 17 which rests on feet 18, 19 presents a drainage valve 20 on its front face.

EXAMPLE 1

In a ten-liter bucket are added five hundred grams of a ceramic fiber resisting a temperature of 1400° C., marketed by Lafarge Réfractaire under the name "K60", of length close to one centimeter.

At the same time, 25 grams of a mechanical paper-making pulp obtained from inked and considerably reinforced salvaged paper, are placed in suspension in half a liter of water.

At ambient temperature, the aqueous suspension of paper-making fibers is added to the suspension of ceramic fibers. 10.5 liters of a first aqueous suspension, containing about 500 grams of ceramic fibers and 25 grams of paper-making fibers, have thus been prepared.

In the same way, a second suspension is prepared, containing, for 10.5 liters, 500 grams of ceramic fibers, but of quality "K45" marketed by Lafarge Réfractaire, resisting only a temperature of 1250° C., and 25 grams of paper-making fibers.

The first suspension based on K60 ceramic fibers is poured into the first compartment 8 and, at the same time, the second suspension of majority K45 fibers is poured into the second compartment 9. The bottom of the vat 1 on which the filtering sieve 15 is disposed is obturated by a sheet of water coming from filling the body 17 to the brim. This sheet thus forms seal between the two compartments. The two prepared suspensions, placed in each distinct compartment 8 and 9, are separated from each other by the removable plate 10. This plate 10 is then removed by drawing it upwards by the tabs 11, 12. In this rising movement, the elementary edges 14 of the comb element 13 provoke in the vicinity of this plate 10 turbulences which locally stir the two suspensions contained in compartments 8 and 9, so that the fibers of these suspensions in the vicinity of this plate 10 are mixed. At the same time, the drainage valve 20 is opened so that the water of each of the suspensions drains away very rapidly, since there is no water retention.

If necessary, the top of the fibrous mast produced is compressed by means of a template so as to obtain a flat surface.

The flange 16 is then opened, then, by drawing the whole by means of the filtering cloth 15, the fibrous mast is brought onto a plate. This material is then stove-dried at 90° C. for four hours. A material shown in FIG. 5 is obtained, with sides measuring about 21 by 29 centimeters for a thickness of 70 millimeters and a density close to 0.2 g/cm$^3$. This material is then placed in a furnace where it is heated for three hours at 1000° C. This temperature firstly provokes combustion of the paper-making fibers, then ceramization of the ashes obtained during such combustion, this binding together the elementary ceramic fibers of each of the suspensions. The block 25 obtained, shown in FIG. 5, is essentially composed of three zones, namely:

a first portion 26, forming hot face, i.e. adapted to come into contact with the hot wall, constituted by the fibers most resistant to temperature, in the present case ceramic K60 fibers resisting 1300° C.;

a second, opposite zone 27 forming cold face, formed by fibers less resistant to temperature (K45);

and an intermediate portion 28 in which these two zones interpenetrate; this portion 28 being essentially formed, about a line of join 29, more precisely by two zones 30, 31, the first 30 being richer in fibers resistant to high temperature and the second 31 being richer in fibers less resistant to high temperature.

The fibers of these three zones are homogeneously bonded to one another by the ceramized ashes resulting from the combustion of paper-making fibers.

EXAMPLE 2

The preceding Example is repeated, replacing the K60 ceramic fiber by a ceramic fiber marketed by Morgan under the name "Cerachrome", of length close to ten centimeters. A block similar to that of Example 1 is obtained, but whose hot face withstands a temperature of 1450° C.

EXAMPLE 3

Example 1 is repeated, but the second compartment 9 is filled not with the suspension of K45 fibers, but of K60 fibers with a concentration reduced by half, i.e. 25 grams instead of 50 grams per liter.

After compacting to a uniform thickness, a block is obtained of which the two faces have a density different from each other.

The denser layer will constitute the cold face, whilst the less dense layer will constitute the hot face.

EXAMPLE 4

Example 1 is repeated, varying the concentration of the paper-making pulp from one compartment to the other. The compartment most laden with paper-making fibers being the most bonded, presents a better cohesion.

EXAMPLE 5

The vat is divided into three identical elementary compartments which are respectively filled:

the first, with a suspension containing in six liters of water, 300 g of K60 ceramic fibers and 15 grams of mechanical paper-making fibers;

the second, with a suspension containing, likewise in six liters of water, 300 grams of K45 ceramic fibers and 15 grams of paper-making fibers;

the third, with a suspension containing, likewise in six liters of water, 300 grams of glass wool and 15 grams of mechanical paper-making fibers.

A block measuring 7×21×29 cm is also obtained, in which the hot face is constituted by the layer based on K60 fibers, whilst the cold face is constituted by the layer of glass wool.

In this case, baking is effected after assembly so that the temperature remains compatible with the glass wool.

EXAMPLE 6

The preceding Example is repeated, but modifying the volume of the different elementary compartments in order to modulate the thickness of each layer.

EXAMPLE 7

The block of Example 1 is immersed before or after baking in an inorganic binding composition constituted by an aqueous solution of alumina phosphate. After immersion and impregnation, the whole is dried for two hours at 90° C.

EXAMPLE 8

Example 1 is repeated with the following modification: An ultrasonic vibration generator is fixed on the outer wall of the vat 1 and is switched on for some seconds after the separating plate 10 has been removed. The ultrasounds provoke a brisk stirring of the liquid mass, this inducing an interpenetration of suspensions which is more regular than that obtained with the comb 13, and a gradient of concentration of the fibers which may be regulated in zone 28 as a function of the stirring time.

EXAMPLE 9

Example 1 is repeated, adding to one or to each of the suspensions an inorganic filler, such as for example kaolin, which modifies the properties of all or part of the piece after baking (porosity, electrical resistivity, mechanical strength, ease of machining, etc . . . ).

The process according to the invention presents numerous advantages over those known heretofore, for example:

the possibility of manufacturing pieces of appropriate dimensions, even of large dimensions, which is translated by a saving of time;

the possibility of manufacturing pieces more cheaply, since only the hot face is made of fibers withstanding the highest temperature;

an improved mechanical strength, since, after heating, the ceramized ashes form a homogeneous inorganic bond;

the possibility of manufacturing shaped pieces by the choice of vats of appropriate form, such as for example arch elements in a furnace;

the facility of handling, thanks to the presence of paper-making fibers, which makes it possible to effect final baking after these pieces have been mounted in the furnace itself;

the possibility of manufacturing pieces of determined shape and specification upon demand and on a small scale.

Consequently, these pieces may be successfully used for insulating the inner linings of furnaces intended to operate at high temperatures.

What is claimed is:

1. A process for manufacturing an insulating fibrous piece based on fibers resisting high temperature, particularly for internally lining heated enclosures, which comprises:

preparing a first suspension containing a first type of fibers resisting high temperature;

preparing at least one second suspension containing a second type of fibers resisting high temperature;

then pouring each suspension into a distinct compartment of a vat of which the bottom comprises a momentarily obstructed filtering sieve and of which the elementary compartments are separated from one another by a removable plate, said process being characterized in that:

each suspension also comprises a minority proportion of ceramizable particles;

whilst withdrawing the removable separating plate, the medium is stirred locally at least in the vicinity of the separation plate and, simultaneously, the water is drained through the filtering sieve;

and, finally, after having dried the piece obtained, it is heated to a temperature capable of provoking in such piece the ceramization of said ceramizable particles.

2. The process of claim 1, wherein the majority temperature-resistant fibers are ceramic fibers.

3. The process of claim 1, wherein the minority ceramizable particles are paper-making fibers.

4. The process of claim 1, wherein the minority paper-making fibers represent 1 to 5% by weight of the dry weight of the majority temperature-resistant fibers.

5. The process of claim 1, wherein an inorganic filler is added to at least one of the elementary suspensions.

6. The process of claim 1, wherein the removable plate includes at least at its end adapted to come into contact with the sieve, a series of transverse edges which form a stirring member during withdrawal of the plate.

7. The process of claim 1, wherein the drained and dried piece is baked at a temperature of at least 1000° C.

8. The process of claim 1, wherein the concentration of the suspensions contained in each compartment varies from one suspension to the other, but the volume of suspension poured into each compartment is identical in order to avoid overflow from one compartment into the other.

9. The process of claim 1, wherein, before or after heating, the piece is coated with an inorganic stove-dried binding composition.

* * * * *